US006620062B2

(12) United States Patent
Taylor et al.

(10) Patent No.: US 6,620,062 B2
(45) Date of Patent: Sep. 16, 2003

(54) DIVOT REPAIR TOOL

(75) Inventors: Stewart Taylor, Kingsport, TN (US); Robert E. Pearman, Gray, TN (US)

(73) Assignee: Taylor Cutlery, LLC, Kingsport, TN (US)

( * ) Notice: Subject to any disclaimer, the term of this patent is extended or adjusted under 35 U.S.C. 154(b) by 0 days.

(21) Appl. No.: 10/013,127

(22) Filed: Dec. 8, 2001

(65) Prior Publication Data

US 2003/0109336 A1 Jun. 12, 2003

(51) Int. Cl.[7] ..... A63B 57/00
(52) U.S. Cl. ..... 473/408
(58) Field of Search ..... 473/408, 286; D21/793; 30/162, 163, 159

(56) References Cited

U.S. PATENT DOCUMENTS 3,360,807 A * 1/1968 Mauck ..... 473/286
3,456,737 A * 7/1969 Rhyme ..... 473/408
3,539,017 A * 11/1970 Johnson ..... 473/408
4,192,066 A * 3/1980 Tucker ..... 30/162
4,628,717 A * 12/1986 Blum ..... 30/162
4,835,865 A * 6/1989 Knoop ..... 30/162
5,388,824 A 2/1995 Reimers
5,449,169 A 9/1995 Hardin et al.
5,562,553 A 10/1996 Digerness et al.
6,336,271 B1 * 1/2002 Rider et al. ..... 30/162
6,413,173 B1 * 7/2002 Muller et al. ..... 473/408
6,413,174 B1 * 7/2002 Roberts ..... 473/408
6,428,430 B1 * 8/2002 Chong ..... 473/408
6,442,843 B1 * 9/2002 Jue et al. ..... 30/162

* cited by examiner

*Primary Examiner*—Steven Wong
(74) *Attorney, Agent, or Firm*—Stevens, Davis, Miller & Mosher LLP

(57) ABSTRACT

A retractable golfer's divot tool comprising a housing, a divot tool slidable inside the housing, a spring connected between the housing and the divot tool and a locking mechanism to lock the divot tool in certain positions. The spring biases the divot tool to extend from the housing so that when the golfer presses a button member in the locking mechanism, the divot tool automatically extends from the housing. Once extended, the locking mechanism locks the divot tool in place allowing the golfer to repair the ball marks on the green. To retract the divot tool back into the housing, the golfer again presses the button member and manipulates a sliding lever to draw the divot tool back into the housing where the locking mechanism again locks the divot tool in place.

17 Claims, 3 Drawing Sheets

DIVOT REPAIR TOOL

The present invention relates to a retractable divot tool for golfers used to manually repair ball marks on greens.

BACKGROUND OF THE INVENTION

Varying designs of divot repair tools are well known in the art. These tools are used to repair the divot remaining on a golfing green following the impact of a golf ball. To prevent damage to the green and to keep a smooth surface, the golfer must repair such mark by lifting the impacted area to fill the cavity. The general design of the golf tool has a pair of tines which are stuck into ground surrounding the divot and manipulated to bring the surrounding turf into the cavity.

However, with the use of such tools, the tines become dirty or muddy after sticking them into the ground. If a golfer carries such devices in his pocket, his pockets will become dirty. These devices are also of such a design that the tines could poke the golfer either when in the pocket or when the golfer reaches into his pocket.

Other designs have divot repair tools retractable into a cover assembly. Such design is disclosed in U.S. Pat. No. 5,449,169 (Hardin et al.) comprising a divot repair tool and a housing with a slot and transverse slots at the ends of the larger slot. The mechanisms for extending and retracting the tool are used in conjunction with the transverse slots whereby a locking mechanism is biased to enter the slot to lock the tool in place. However, the user must push in a button and manually move the tool from the retracted to the extended position or vice versa.

Other devices use a slidable divot tool in conjunction with other tools. U.S. Pat. No. 5,562,553 (Digerness et al.) discloses a slidable divot tool in conjunction with a pencil sharpener. U.S. Pat. No. 5,388,824 (Reimers) discloses a retractable divot tool in conjunction with a plurality of other devices, such as a ball marker, iron groove brush and a picking tool. Such tools provide a compact divot tool device. However, such tools also require a manual sliding of the divot tool to the extended position.

SUMMARY OF INVENTION

It is therefore an object of the invention to provide a retractable divot tool having a spring assisted tool extension. It is another object of the invention to provide a divot tool capable of retracting into a housing to prevent the user's pockets from accumulating dirt and mud during a round of golf It is a further object of the invention to provide a retractable divot tool to prevent the user from being poked by the tool when the tool is not in use.

These and other objects are achieved with the use of the claimed invention. The invention comprises a housing, a retractable divot tool retractable into an out of the housing, a spring mechanism for assisting the extension of the tool from the housing and a button member for unlocking the tool when the tool is in its extended and retracted position. Upon manipulation of the button member, the divot tool via the spring mechanism is biased towards the extended position and is locked again when the tool is fully extended. Again upon manipulation of the button member and the manipulation of a lever member connected to the tool, the tool may be retracted back into the housing.

BRIEF DESCRIPTION OF THE DRAWINGS

A preferred embodiment of the invention will be described below with reference to the associated drawings in which.

DETAILED DESCRIPTION OF THE PREFERRED EMBODIMENT

Figure 1:
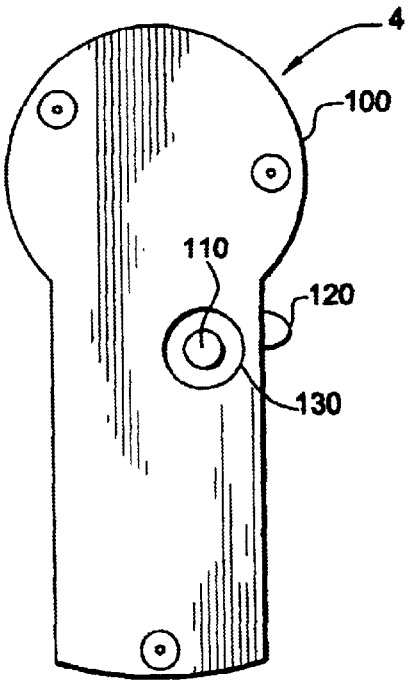
FIG. 1 is a perspective view of the divot repair tool with the repair member in the retracted position.

Referring to the drawings by characters of reference, FIGS. 1–9 disclose a divot repair tool 4 having generally an elongated housing 100, a repair member 410, a spring member 400 and a button member 110. Housing 100 encases repair member 410 and has a pair of openings on its end which allow tines 310 and 312 to extend out from housing 100. When the tines are fully extended, the golfer using the tool can use the tines to repair a ball mark on a green. The method of repairing the ball marks on a green is known to those skilled in the art or to golfers in general, so a discussion of the use of the divot repair tool 4 will not be described herein.

Figure 2:
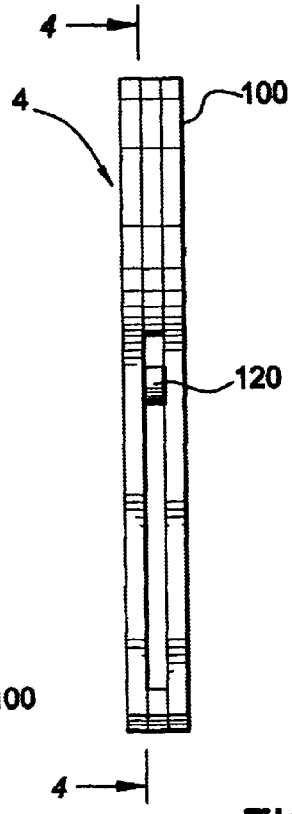
FIG. 2 is a side view of the divot repair tool as shown in FIG. 1.
Figure 3:
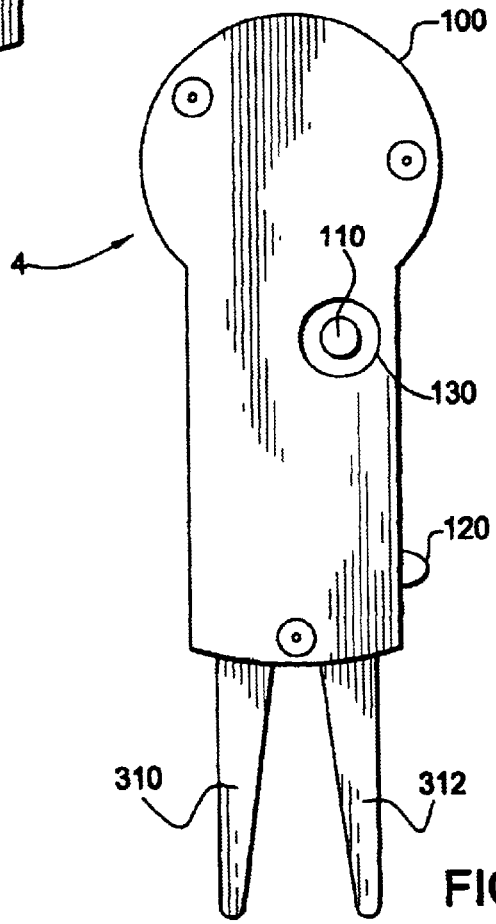
FIG. 3 is a perspective view of the divot repair tool with the repair member in the extended position.

FIGS. 1 and 3 show the divot repair tool 4 according to a preferred embodiment in its retracted state and its extended state, respectively. The divot repair tool comprises housing 100, button member 110 and lever member 120. Upon pressing button member 110, the divot repair tool 4 changes from its retracted state to its extended state as shown in FIG. 3, where tines 310 and 312 extend from housing 100 through apertures 460 and 462 (shown in FIG. 4). To retract tines 310 and 312, the golfer must again press button 110 and then move lever 120 toward the head portion of housing 100. FIG. 2 shows a side view of divot repair tool 4 and the location of lever 120 within housing 100.

The inner structure of the divot repair tool is shown in detail in FIGS. 4–9. Repair member 410 is an elongated planar structure having a pair of tines 310 and 312 at an end thereof. Lever 120 is located on an adjacent side from the tines. Repair member 410 also has a slot 470 with two widths, a first width at a first end portion 440 and second end portion 441 at the ends of slot 470 and a second width along the middle portion 450. Second width 450 is narrower than the first width at end portions 440 and 441. The end portions 440 and 441 and second width 450 interact with button member 110 for locking and allowing movement of repair member 410. Repair member 410 also includes pins 422 and 424 which interact with travel slot 420 of housing 100 to guide the repair member 410 along the length of housing 100.

Divot repair tool 4 also includes a spring 400 located between housing 100 and repair member 410. Spring 400 provides resistance to compression which biases repair member 410 to move away from the head portion of housing 100 and to extend tines 310 and 312 from housing 100 through holes 460 and 462.

Figure 4:
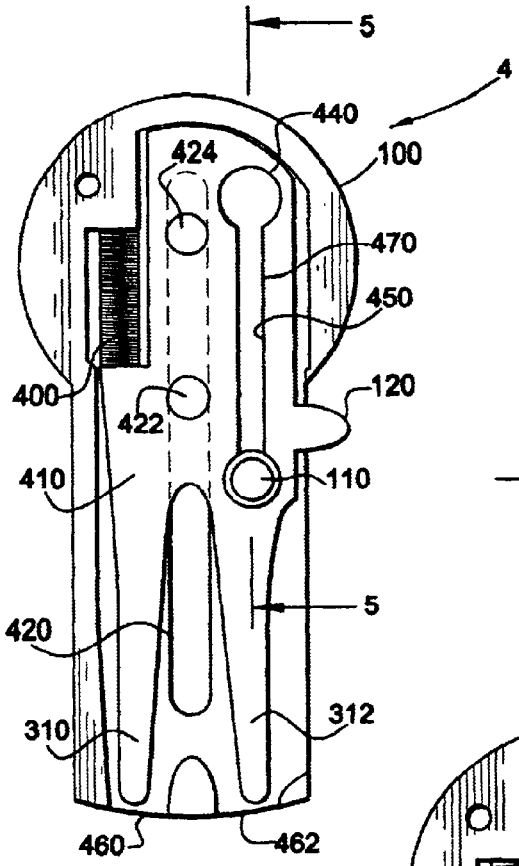
FIG. 4 is a section view of the divot repair tool along line 4—4 of FIG. 2.

Button member 110 fits into slot 470 and includes two widths, a wide portion 520 and a narrow portion 510. Wide portion 520 has a greater diameter than the second width 450 and a narrower diameter than the first width of end portions 440 and 441. Narrow portion 510 has a diameter less than the second width 450. Button member 110 can only move along its axis and is prevented from lateral movement by a through hole 130 in housing 100 (FIGS. 1 and 3). A button spring 530 biases button member 110 in a direction opposite to direction P shown in FIG. 5, which aligns wide portion 520 with the second end portion 441. Since wide portion 520 has a greater diameter than second width 450, repair member 410 is locked into the retracted position as shown in FIGS. 4 and 5.

Figure 5:
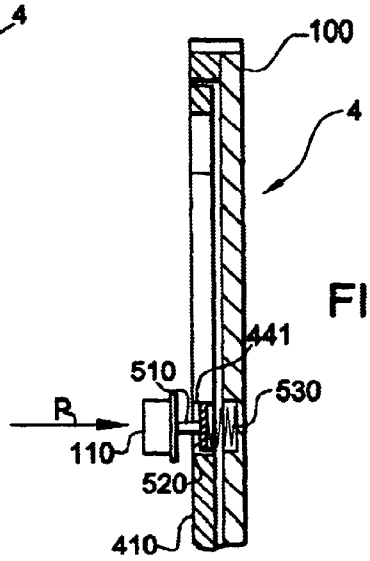
FIG. 5 is a section view of the divot repair tool along line 5—5 of FIG. 4 showing the operation and structure of the button member.
Figure 6:
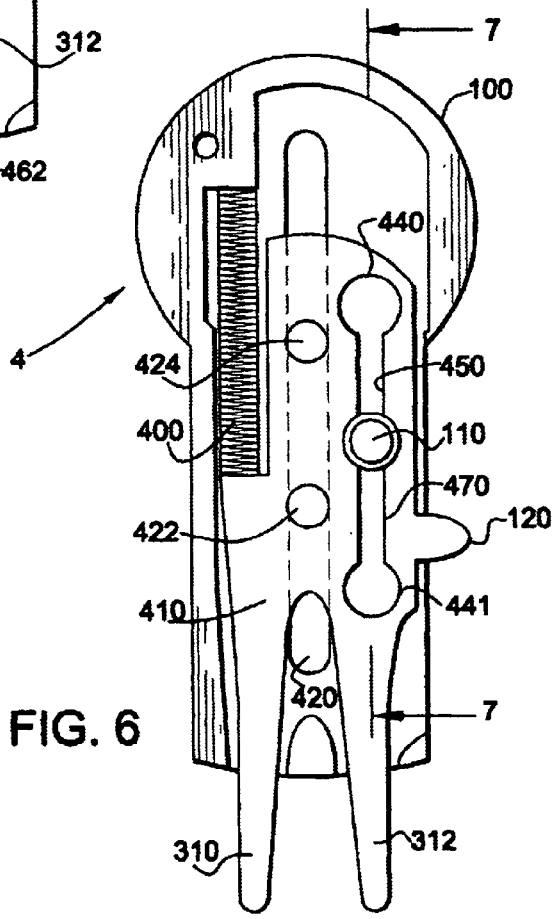
FIG. 6 is a similar view as FIG. 4, but with the repair member in a halfway-extended position.
Figure 7:
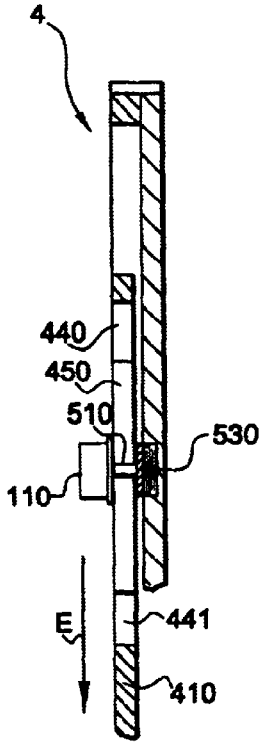
FIG. 7 is a section view of the divot repair tool along line 7—7 of FIG. 6.

Upon a depression along the axis of button member 110 in direction P as shown in FIG. 5, narrow portion 510 becomes aligned with end portions 440 and 441 and second width 450 as is shown in FIG. 7. Since narrow portion 510 is narrower than the first width of end portions 441 and 442 and second width 450, repair member 410 is able to move relative to housing 100 and button member 110 in direction E. As repair member 410 is able to move, spring 400 pushes repair member 410 away from the head portion of housing 100. This begins to extend tines 310 and 312 from housing 100, as is shown in FIGS. 6 and 7.

Figure 8:
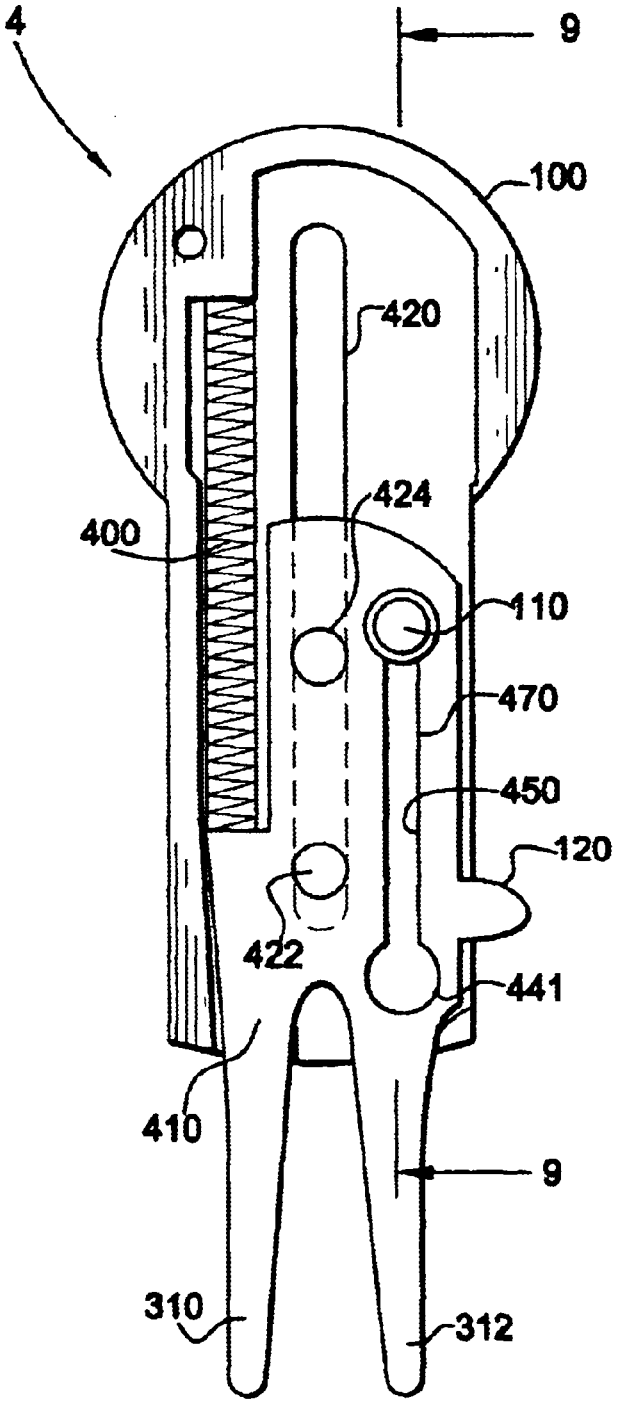
FIG. 8 is a similar view as FIG. 4 and FIG. 6, but with the repair member in its fully extended and locked position.
Figure 9:
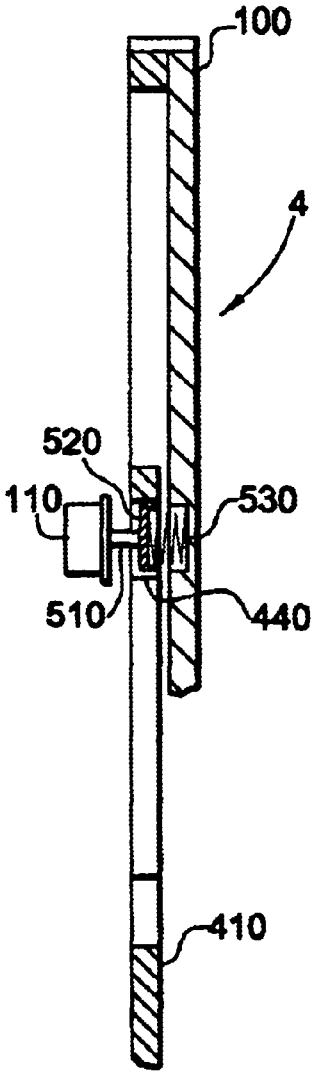
FIG. 9 is a section view of the divot repair tool along line 9—9 of FIG. 8 showing the button member locking the repair member in its fully extended position.

Repair member 410 moves away from the head portion of housing 100 until button member 110 becomes aligned with the end of slot 470 at first end portion 440. This corresponds to the full extension of tines 310 and 312. At this point, the biasing of button member 110 by button spring 530 urges wide portion 520 into first end portion 440 which locks repair member 410 into its extended position as shown in FIGS. 8 and 9.

To return the tines 310 and 312 into their retracted position, button member 110 again must be pressed in direction P to align the narrow width 510 with end portions 440 and 441 and second width 450 which will again allow repair member 410 to move relative to housing 100 and button member 110. The golfer then moves lever 120 of repair member 410 in a direction opposite E which begins to retract tines 310 and 312 into housing 100. Once the golfer begins to retract repair member 410, the golfer may then discontinue pressing button member 110. When tines 310 and 312 of repair member 410 are fully retracted to the point where button member 110 aligns with second end portion 441, button spring 530 will then move wide portion 520 of button member 110 into second end portion 441 which will lock repair member 410 in housing 100 as shown in FIGS. 4 and 5.

The above description describes a preferred embodiment of the invention. Since numerous modifications and changes will readily occur to those skilled in the art, it is not desired to limit the invention to the exact construction and operation as shown and described. Accordingly, all such suitable modifications and equivalents fall within the scope of the present invention.

I claim:

1. A divot tool comprising:

a housing;

a member having a portion including at least one tine extending from one end thereof displaceable between a retracted position wherein said member is entirely disposed within said housing and an extended position wherein said tine portion is disposed without said housing;

means interposed between said housing and said member for biasing said member in said extended position;

a button for releasably locking said member selectively in said retracted and extended positions by interacting with a slot in said member to releasably lock said member in said retracted position and said extended positions; and wherein said member includes a portion engageable by a digit of the user for drawing said member from said extended position to said retracted position against the action of said biasing means and wherein said slot has a first width at each end thereof and a second width along the middle portion thereof less than the first width.

2. The divot tool according to claim 1 wherein said button includes a first wide width less than the first width of said slot but greater than the second width of said slot and a narrow width less than the second width of said slot.

3. The divot tool according to claim 2 wherein said button locks said member when the wide width of said button is associated with said first width of said slot.

4. A divot tool comprising:

a housing:

a member having a portion including at least one tine extending from one end thereof, displaceable between a retracted position wherein said member is entirely disposed within said housing and an extended position wherein said tine portion is disposed without said housing;

means interposed between said housing and said member for biasing said member in said extended position;

a button for releasably locking said member selectively in said retracted and extended positions by interacting with said member to releasably lock said member in said retracted position and said extended positions; and a button spring biasing said button to lock said member, wherein said member includes a portion engageable by a digit of the user for drawing said member from said extended position to said retracted position against the action of said biasing means.

5. The divot tool according to claim 1 wherein the means for biasing said member into an extended position comprises a spring.

6. The tool according to claim 1 wherein the member has two tines extending in a direction parallel to each other.

7. The tool according to claim 6, wherein said housing has two apertures for allowing said tines to extend from said housing.

8. A divot tool comprising:

a housing;

a member having a portion including at least one tine from one end thereof, displaceable between a retracted position wherein said member is entirely disposed within said housing and an extended position wherein said tine portion is disposed without said housing;

means interposed between said housing and said member for biasing said member in said extended position; and means for releasably locking said member selectively in said retracted and extended positions comprising a button having a portion extending into a slot of said member to lock said member into said retracted and extended positions, wherein a spring biases said button to extend said portion of said button into the slot of said member.

9. The divot tool according to claim 8 wherein the member includes a lever for drawing said member from said extended position to said retracted position against the action of said biasing means.

10. The divot tool according to claim 8 wherein the member has a pair of tines extending in a direction parallel to each other.

11. The divot tool according to claim 10 wherein said housing has a pair of apertures corresponding to said pair of tines.

12. A tool comprising:

a housing;

a member having a portion including at least one protrusion extending from one end thereof, displaceable between a retracted position wherein said member is entirely disposed within said housing and an extended position wherein said protrusion is disposed without said housing;

means interposed between said housing and said member for biasing said member in said extended position;

means for releasably locking said member selectively in said retracted and extended positions comprising a button cooperating with said member that is biased via a spring to lock said member in said retracted and extended positions; and wherein said member includes a flange engageable by a digit of the user for drawing said member from said extended position to said retracted position against the action of said biasing means.

13. The tool according to claim 12 wherein the button cooperates with a slot in the member to lock said member.

14. The tool according to claim 13 wherein said slot has a first width at each end thereof and a second width along the middle portion thereof less than the first width and said button includes a first wide width less than the first width of said slot but greater than the second width of said slot and a narrow width less than the second width of said slot.

15. The divot tool according to claim 4 wherein the means for biasing said member into an extended position comprises a spring.

16. The tool according to claim 4 wherein the member has two tines extending in a direction parallel to each other.

17. The tool according to claim 16, wherein said housing has two apertures for allowing said tines to extend from said housing.

* * * * *